US007237693B2

(12) United States Patent
Brennan et al.

(10) Patent No.: US 7,237,693 B2
(45) Date of Patent: Jul. 3, 2007

(54) DUAL FLUID CARTRIDGE FOR STORING AND DISPENSING FLUIDS IN UNEQUAL RATIOS

(75) Inventors: Robert C. Brennan, Bordentown, NJ (US); Phillip W. Hamilton, Bradley Beach, NJ (US); Jason E. Henning, Bordentown, NJ (US); Daniel William Mottram, Cream Ridge, NJ (US); Dwayne J. Pulcine, Lacey, NJ (US); Robert W. Springhom, Cream Ridge, NJ (US)

(73) Assignee: Tah Industries, Inc., Robbinsville, NJ (US)

( * ) Notice: Subject to any disclaimer, the term of this patent is extended or adjusted under 35 U.S.C. 154(b) by 330 days.

(21) Appl. No.: 10/938,328

(22) Filed: Sep. 10, 2004

(65) Prior Publication Data

US 2006/0054636 A1 Mar. 16, 2006

(51) Int. Cl.

| | |
|---|---|
| ***B67D 5/042*** | (2006.01) |
| ***B67D 5/052*** | (2006.01) |
| ***B67D 5/06*** | (2006.01) |
| ***B65D 88/054*** | (2006.01) |

(52) U.S. Cl. ..... 222/327; 222/137; 222/145.1; 222/386

(58) Field of Classification Search ..... 222/129, 222/135, 137, 145.1, 327, 386
See application file for complete search history.

(56) References Cited

U.S. PATENT DOCUMENTS 2,001,819 A * 5/1935 Elle et al. ..... 222/143
2,754,490 A 7/1956 Cohen
3,370,754 A 2/1968 Cook et al.
3,380,451 A 4/1968 Porter et al.

(Continued)

FOREIGN PATENT DOCUMENTS

DE 19744746 4/1999

(Continued)

OTHER PUBLICATIONS

M. Eberwein, "European Search Report", Aug. 19, 2005, 3 pages.

(Continued)

*Primary Examiner*—Joseph A. Kaufman
*Assistant Examiner*—Melvin A. Cartagena
(74) *Attorney, Agent, or Firm*—LeFevour Law Group, LLC; Martin LeFevour

(57) ABSTRACT

A dual fluid cartridge for storing and dispensing fluids in unequal ratios is disclosed. The dual fluid cartridge disclosed defines two fluid chambers for a fluid to be held in greater amount and defines another fluid chamber for a fluid to be held in lesser amount. The two fluid chambers holding the fluid of greater amount are in fluid communication with one another through a delivery channel. Because of this arrangement, the dual fluid cartridge is very suitable and highly effective in situations where a dual fluid cartridge is needed to store and dispense fluids of unequal ratios (e.g. a 10:1 ratio, a 9:1 ratio, an 8:1 ratio, a 7:1 ratio etc.). With such an arrangement, the amount of space wasted in the cartridge is minimized, which maximizes the amount of fluids that can be stored in the cartridge. As a result, the total final product that can be dispensed from the dual fluid cartridge is also maximized.

27 Claims, 7 Drawing Sheets

U.S. PATENT DOCUMENTS

| | | | | |
|---|---|---|---|---|
| 3,437,242 | A | 4/1969 | Poitras | |
| 3,477,431 | A | 11/1969 | Walecka | |
| 3,595,439 | A | 7/1971 | Newby et al. | |
| 3,678,931 | A | 7/1972 | Cohen | |
| 3,682,174 | A | 8/1972 | Cohen | |
| 3,684,136 | A | 8/1972 | Maumann | |
| 3,760,503 | A | 9/1973 | Baskas | |
| 3,885,710 | A | 5/1975 | Cohen | |
| 3,945,735 | A * | 3/1976 | Nakashiki et al. | 401/216 |
| 4,014,463 | A * | 3/1977 | Hermann | 222/135 |
| 4,029,236 | A | 6/1977 | Carson et al. | |
| 4,050,612 | A * | 9/1977 | Stone | 222/135 |
| 4,159,570 | A | 7/1979 | Baskas et al. | |
| 4,538,920 | A | 9/1985 | Drake | |
| 4,648,532 | A | 3/1987 | Green | |
| 4,771,919 | A | 9/1988 | Ernst | |
| 4,941,751 | A | 7/1990 | Muhlbauer | |
| 4,969,747 | A | 11/1990 | Colin et al. | |
| 4,986,443 | A | 1/1991 | Saur et al. | |
| 5,058,770 | A | 10/1991 | Herold et al. | |
| 5,172,807 | A | 12/1992 | Dragan et al. | |
| 5,310,091 | A * | 5/1994 | Dunning et al. | 222/135 |
| 6,048,201 | A | 4/2000 | Zwingenburger | |
| 6,116,900 | A | 9/2000 | Ostler | |
| 6,328,715 | B1 | 12/2001 | Dragon et al. | |
| 6,398,761 | B1 | 6/2002 | Bills et al. | |
| 6,454,129 | B1 | 9/2002 | Green | |
| 6,634,524 | B1 | 10/2003 | Helmenstein | |
| 6,652,494 | B1 | 11/2003 | Dragon et al. | |
| 6,843,652 | B2 | 1/2005 | Xie et al. | |
| 6,848,480 | B2 * | 2/2005 | Brennan | 141/2 |
| 6,869,419 | B2 | 3/2005 | Dragon et al. | |

FOREIGN PATENT DOCUMENTS

| | | |
|---|---|---|
| DE | 10132417 | 1/2003 |
| FR | 2418173 | 9/1979 |
| WO | WO 2005/005305 | 1/2005 |
| WO | WO2005005305 | 1/2005 |

OTHER PUBLICATIONS

D. Jelercic, "European Search Report", Apr. 18, 2006, 3 pages.

* cited by examiner

DUAL FLUID CARTRIDGE FOR STORING AND DISPENSING FLUIDS IN UNEQUAL RATIOS

BACKGROUND

Dual fluid cartridges are used to store and dispense two fluids which must be kept separate until the time of use and then, at the time of dispensing, need to be mixed together very quickly in a precise pre-set ratio to ensure that the proper chemical reaction takes place. If the cartridge does not dispense the two fluids properly in the required pre-set ratio, the final fluid mixture may be greatly affected and may not function or adhere as required. Examples of such fluids are those that are used to create thermoset adhesives (i.e., a resin and a hardener).

Dual fluid cartridges have been used in industry for a long time and, over the years, differing types of dual fluid cartridges have been developed. An example of a relatively recently developed dual fluid cartridge is the one depicted and described in U.S. Pat. No. 5,310,091, entitled "Dual Product Dispenser". The dual fluid cartridge depicted and described in the '091 patent is an effective dual fluid cartridge. It can be filled relatively easily and can be used in readily available dispensers, such as caulking guns. With fluids that need to be combined in a 1:1 ratio, the dual fluid cartridge of the '091 patent is especially effective. The dual fluid cartridge of the '091 patent may also be used with fluids that need to be combined in a non-1:1 ratio (e.g. 2:1 ratio). However, when the ratio of the two fluids that need to be combined starts to deviate from 1:1, the dual fluid cartridge of the '091 patent becomes less effective. Because the dual fluid cartridge of the '091 patent only has two chambers to hold fluid, as the ratio between the two fluids that need to be stored and dispensed increases, the space wasted in the cartridge increases and the amount of final product that can be produced decreases. At high ratios (e.g. a 10:1 ratio), the space wasted within the cartridge and the reduction in final product that can be produced becomes significant.

Accordingly, there is a need for a dual fluid cartridge that is effective in storing and dispensing fluids in unequal ratios such that there is minimal wasted space in the cartridge and the total final product capable of being dispensed is maximized.

SUMMARY

In accordance with one aspect of the present invention, a fluid cartridge for storing and dispensing two fluids, wherein one of the fluids to be stored and dispensed is of a greater amount than the second fluid, includes an outer cartridge wall defining an outlet and an open end opposite the outlet and an inner cartridge wall disposed within the outer cartridge wall and defining an outlet that is co-located with the outlet defined by the outer cartridge wall. A first piston is disposed within the inner cartridge wall, such that the inner cartridge wall and the first piston define a fluid chamber for the fluid of lesser amount. A second piston is disposed between the outer cartridge wall and the inner cartridge wall to form a first fluid chamber for the fluid of greater amount. A third piston is disposed within the outer cartridge wall between first piston and the open end of the outer cartridge wall. Further, a fixed wall is disposed between the first piston and the third piston, such that the fixed wall and the third piston define a second fluid chamber for the fluid of greater amount. Means for transmitting force from the third piston to the first piston, and means for transmitting force from the third piston to the second piston are included. A delivery channel is disposed between the first and second fluid chambers for the fluid of greater amount to allow fluid communication between the first and second fluid chambers for the fluid of greater amount.

In the fluid cartridge in accordance with this aspect of the present invention, the ratio between the fluid of greater amount and the fluid of lesser amount may be 10:1, 2:1 or some other ratio. The fluid cartridge may also include a plurality of delivery channels disposed between the first and second fluid chambers for the fluid of greater amount. The delivery channel may also be the force transmitting means from the third piston to the second piston or the delivery channel may be the force transmitting means from the third piston to the first piston. The delivery channel may be formed integral with the inner cartridge wall. The delivery channel may be crescent-shaped or may be an annular passage. Also, the outlet defined by the outer cartridge wall may have an interior and the outlet defined by the inner cartridge wall may be disposed within and span the interior of the outer cartridge wall outlet. The inner cartridge wall outlet may also define a first opening for discharge of the fluid of greater amount and a second opening for discharge of the fluid of lesser amount. The inner cartridge wall outlet may also have an exterior surface with ribs formed along the exterior surface, wherein the ribs secure the inner cartridge wall outlet within the interior of the outer cartridge wall outlet.

According to another aspect of the invention, a fluid cartridge for storing and dispensing two fluids, wherein one of the fluids to be stored and dispensed is of a greater amount than the second fluid, includes an outer cartridge wall defining an outlet and an open end opposite the outlet and an inner cartridge wall disposed within the outer cartridge wall and defining an outlet that is co-located with the outlet defined by the outer cartridge wall. A first piston is disposed within the inner cartridge wall, such that the inner cartridge wall and the first piston define a fluid chamber for the fluid of lesser amount. A second piston is disposed between the outer cartridge wall and the inner cartridge wall to form a first fluid chamber for the fluid of greater amount. A third piston is disposed within the outer cartridge wall between first piston and the open end of the outer cartridge wall. Further, a fixed wall is disposed between the first piston and the third piston, such that the fixed wall and the third piston define a second fluid chamber for the fluid of greater amount. A first transmission structure is disposed between the third piston and the first piston, and a second transmission structure is disposed between the third piston and the second piston. A delivery channel is disposed between the first and second fluid chambers for the fluid of greater amount to allow fluid communication between the first and second fluid chambers for the fluid of greater amount.

In the fluid cartridge in accordance with this aspect of the present invention, the ratio between the fluid of greater amount and the fluid of lesser amount may be 10:1, 2:1 or some other ratio. The fluid cartridge may also include a plurality of delivery channels disposed between the first and second fluid chambers for the fluid of greater amount. The delivery channel may also be formed integral with the first transmission structure or the second transmission structure. The delivery channel may be formed integral with the inner cartridge wall. The delivery channel may be crescent-shaped or may be an annular passage. Also, the outlet defined by the outer cartridge wall may have an interior and the outlet defined by the inner cartridge wall may be disposed within and span the interior of the outer cartridge wall outlet. The inner cartridge wall outlet may also define a first opening for discharge of the fluid of greater amount and a second opening for discharge of the fluid of lesser amount. The inner cartridge wall outlet may also have an exterior surface with ribs formed along the exterior surface, wherein the ribs secure the inner cartridge wall outlet within the interior of the outer cartridge wall outlet.

According to another aspect of the present invention, a fluid cartridge for storing and dispensing two fluids, wherein one of the fluids to be stored and dispensed is of a greater amount than the second fluid, includes an outer cartridge wall defining an outlet and an open end opposite the outlet and an inner cartridge wall disposed within the outer cartridge wall and defining an outlet that is co-located with the outlet defined by the outer cartridge wall. A first piston is disposed within the inner cartridge wall, such that the inner cartridge wall and the first piston define a first fluid chamber for the fluid of greater amount. A second piston is disposed between the outer cartridge wall and the inner cartridge wall forming a fluid chamber for the fluid of lesser amount. A third piston is disposed within the outer cartridge wall between first piston and the open end of the outer cartridge wall. Further, a fixed wall is disposed between the first piston and the third piston, such that the fixed wall and the third piston define a second fluid chamber for the fluid of greater amount. Means for transmitting force from the third piston to the first piston, and means for transmitting force from the third piston to the second piston are included. A delivery channel is disposed between the first and second fluid chambers for the fluid of greater amount to allow fluid communication between the first and second fluid chambers for the fluid of greater amount. In the fluid cartridge in accordance with this aspect of the present invention, the ratio between the fluid of greater amount and the fluid of lesser amount may be 10:1, 2:1 or some other ratio.

DESCRIPTION OF THE DRAWINGS

These and other features, aspects and advantages of the present invention will become better understood with regard to the following description, appended claims and accompanying drawings where:

DETAILED DESCRIPTION

Figure 1:
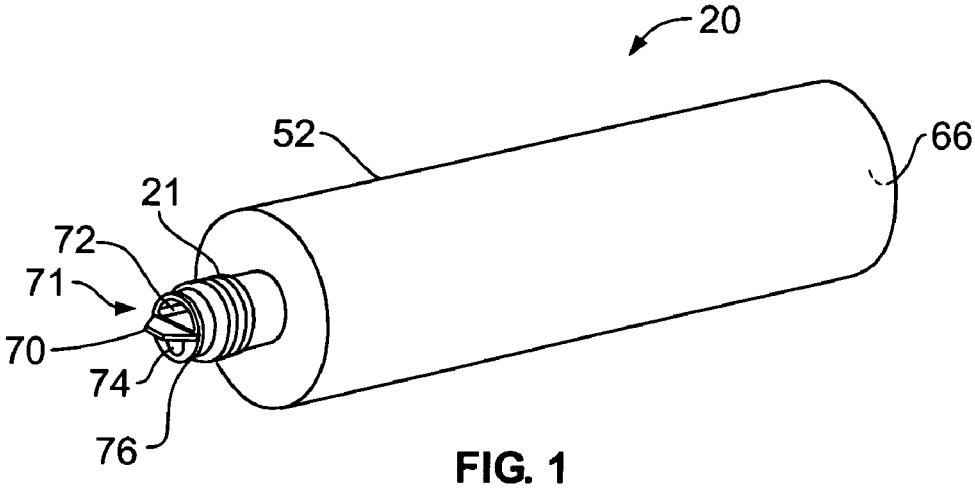
FIG. 1 depicts an embodiment of a dual fluid cartridge of the present invention.
Figure 1A:
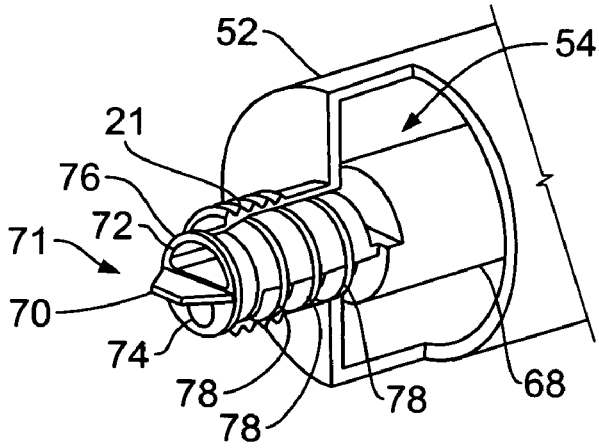
FIG. 1A illustrates a portion of the dual fluid cartridge of FIG. 1 with a portion of an outer cartridge wall broken away to show an inner outlet portion of the outlet of FIG. 1.
Figure 2:
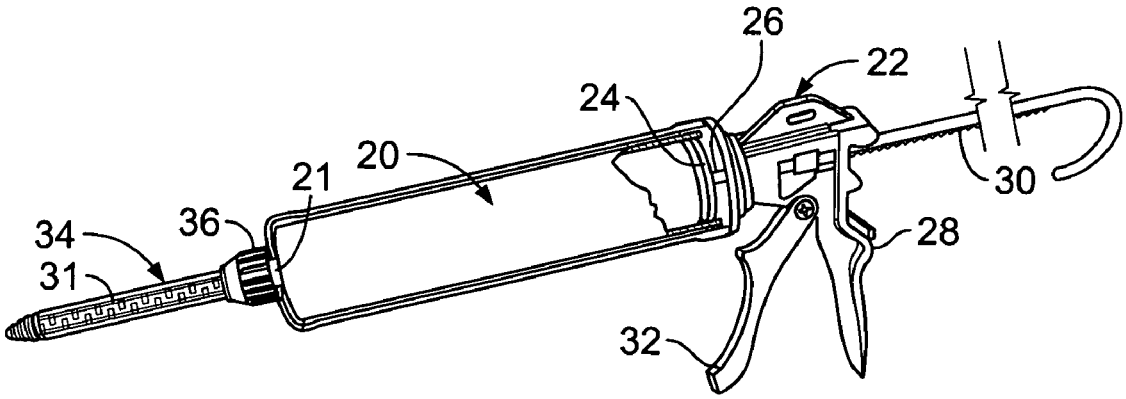
FIG. 2 depicts an embodiment of a dual fluid cartridge of the present invention with a nozzle attached and with the dual fluid cartridge disposed in a dispenser, with a portion of the dual fluid cartridge and the dispenser broken away.

Referring to FIGS. 1 and 1A, an embodiment of a dual fluid cartridge 20 in accordance with the present invention is depicted. The dual fluid cartridge 20 has an outlet 71 which includes an externally threaded outer outlet wall 21 and an inner outlet portion 70 and, as explained in detail below, the dual fluid cartridge 20 stores two fluids separately from one another until a user is ready to mix the fluids together using a dispenser. In FIG. 2, the dual fluid cartridge 20 is shown disposed in a dispenser 22, which in FIG. 2 is depicted as a standard manual caulking gun. However, it should be understood that the dual fluid cartridge 20 of the present invention may be used with any form or type of dispenser 22 and is not limited to just manual caulking guns. For example, other dispensers 22 may have different shapes or sizes and may be actuated pneumatically, hydraulically, by battery power or by some form of mechanical drive, such as an actuating screw. The dispenser 22 shown in FIG. 2 has a plunger 24 which is connected to a rod 26 that extends through a handle 28 of the dispenser 22. The rod 26 has ratchet teeth 30 formed on the rear portion of the rod. The dispenser 22 also has a trigger 32 which, when actuated, engages the ratchet teeth 30, advancing the plunger 24 forward. The continued actuation of the trigger 32 causes the plunger 24 to eventually engage and apply pressure against the rear portion of the dual fluid cartridge 20, which, as explained in more detail below, causes the two fluids stored in the cartridge 20 to be dispensed and mixed together.

The dual fluid cartridge 20 in FIG. 2 also has a nozzle 34 attached to the end of the cartridge 20. In this embodiment, the nozzle 34 is attached to the dual fluid cartridge 20 by screwing a retaining nut 36 on to the threaded outer outlet wall 21 of the cartridge 20. Typically, the nozzle 34 contains a static mixer 31 within it. The static mixer 31 mixes the two fluids stored in the dual fluid cartridge 20 together as the dispenser 22 dispenses them from the cartridge 20.

Figure 3:
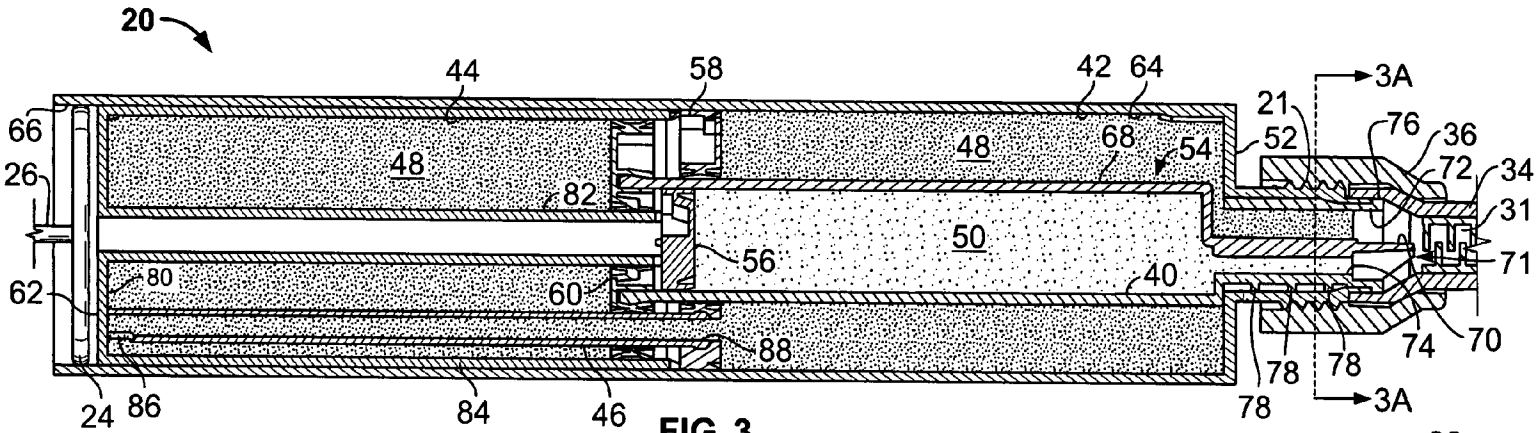
FIG. 3 is a longitudinal sectional view of a filled embodiment of a dual fluid cartridge of the present invention, which is depicted along with a portion of an attached nozzle and static mixer in section and the plunger and a portion of the rod of the dispenser depicted in FIG. 2.
Figure 3A:
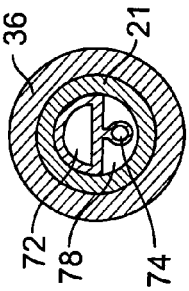
FIG. 3A is cross-sectional view taken along line 3A-3A of FIG. 3.

Referring to FIGS. 3 and 3A, the dual fluid cartridge 20 of this embodiment defines three fluid chambers 40, 42, 44, with two of the chambers 42, 44 in fluid communication with one another through a delivery channel 46. Because of this arrangement, the dual fluid cartridge 20 is very suitable and highly effective in situations where a dual fluid cartridge is needed to store and dispense fluids of unequal ratios (e.g. a 10:1 ratio, a 9:1 ratio, an 8:1 ratio, a 7:1 ratio etc.). The two chambers in fluid communication with one another 42, 44 through the delivery channel 46 are filled with the fluid required to be stored and dispensed in greater amount 48 (e.g. the 10 component of a 10:1 ratio mixture) and the remaining chamber 40 is filled with the fluid required to be stored and dispensed in lesser amount 50 (e.g. the 1 component of a 10:1 ratio mixture). With such an arrangement, the amount of space wasted in the cartridge 20 is minimized, which maximizes the amount of fluids 48, 50 that can be stored in the cartridge 20. As a result, the total final product that can be dispensed from the dual fluid cartridge 20 is also maximized.

In this embodiment of the dual fluid cartridge 20, the cartridge 20, in addition, includes an outer cartridge wall 52, an inner chamber structure 54, a first piston 56, a second piston 58, a compression wall 60 and a rear piston assembly 62. The outer cartridge wall 52 in this embodiment is a cylindrical wall defining a hollow interior 64. In a preferred embodiment, the outer cartridge wall 52 of the cartridge 20 is an industry standard design that is designed to fit into a standardized piece of dispensing equipment, such as a caulking gun as described above. The outer cartridge wall 52, in this embodiment, at one end defines an opening 66 and has the external threaded outer outlet wall 21 of the dual fluid cartridge 20 at the other end. The inner chamber structure 54 of the cartridge 20 is disposed within the hollow interior 64 of the outer cartridge wall 52. The inner chamber structure 54 includes an inner cartridge wall 68 and, in this embodiment, the inner outlet portion 70 which defines two discharge openings 72, 74. In this embodiment, the opening 72 is for the fluid of greater amount 48 to pass through, and the opening 74 is for the fluid of lesser amount 50 to pass through. The ratio in which the fluids 48, 50 must be dispensed from the cartridge 20 determines the size of the openings 72, 74 relative to one another. In this embodiment, the inner chamber structure 54 snaps into locking engagement with the outer cartridge wall 52 to form the outlet 71. The inner outlet portion 70 of the inner chamber structure 54 has an annular engagement lip 76 formed at the end of the inner outlet portion 70. When the inner chamber structure 54 is inserted into the hollow interior 64 of the outer cartridge wall 52, the inner outlet portion 70 of the inner chamber structure 54 is inserted into the interior of the outer outlet wall 21 of the outer cartridge wall 52. The inner chamber structure 54 is pushed forward within the interior 64 of the outer cartridge wall 52 until the engagement lip 76 pushes through and emerges from the interior of the outer outlet wall 21, engaging the end of the outer outlet wall 21. The inner outlet portion 70, in this embodiment, also has a series of ribs 78 formed along its length. In the assembled configuration, the ribs 78 contact the interior of the outer outlet wall 21. This causes the inner outlet portion 70 to fit snugly against the interior of the outer outlet wall 21, keeping fluid from leaking between the inner outlet portion 70 of the outlet 71 and the outer outlet wall 21.

The first piston 56 of the dual fluid cartridge 20 is disposed within the inner chamber structure 54. The first piston 56 and the inner cartridge wall 68 define the chamber 40 which holds the fluid required in lesser amount 50. The second piston 58 of the dual fluid cartridge 20 is disposed within the cartridge 20 between the exterior of the inner cartridge wall 68 and the interior of the outer cartridge wall 52. In this embodiment, the second piston 58 surrounds the inner cartridge wall 68. The second piston, in conjunction with the exterior of the inner cartridge wall 68 and the interior of the outer cartridge wall 52, defines the chamber 42, which in this embodiment is a first chamber for holding a portion of the fluid required in greater amount 48.

The compression wall 60 is disposed between the inner chamber structure 54 and the rear piston assembly 62. In this embodiment, the compression wall 60 is connected to the inner chamber structure 54 which fixes the compression wall 60 in place. The rear piston assembly 62 and the compression wall 60 define the chamber 44, which in this embodiment is a second chamber for holding the remaining portion of the fluid required in greater amount 48. The delivery channel 46 provides fluid communication between the first and second chambers 42, 44 for the fluid of greater amount 48. The delivery channel 46 defines an entry opening 86 which, in this embodiment, is positioned in the second chamber 44 for the fluid of greater amount 48. The delivery channel 46 also defines an exit 88 which, in this embodiment, opens into the first chamber 42 for the fluid of greater amount 48.

The rear piston assembly 62 includes a rear piston surface 80, a first transmission structure 82 and a second transmission structure 84. In this embodiment, the differing portions 80, 82, 84 of the rear piston assembly are all integral with one another, but this is not necessary. One of ordinary skill in the art would understand that it is possible that each portion of the rear piston assembly 62 could be its own separate structure. In this embodiment, the first transmission structure 82 extends from the rear piston surface 80 of the rear piston assembly 62, passes through the compression wall 60 and is in engagement with the first piston 56. In this embodiment, the second transmission structure 84 extends from the rear piston surface 80 of the rear piston assembly 62, passes snugly between the compression wall 60 and the interior of the outer cartridge wall 52 forming a seal and is in engagement with the second piston 58.

To dispense the fluids from the dual fluid cartridge 20, the rear piston assembly 62 is pressed forward towards the cartridge outlet 71. In the embodiment described, this is done by actuation of the caulking gun plunger 24. As the plunger 24 is actuated forward, in the direction indicated by the arrow in FIG. 4, the plunger 24 presses against the rear piston assembly 62. Simultaneously, the rear piston surface 80 pushes against the fluid 48 stored in chamber 44, the first transmission structure 82 presses against the first piston 56 and the second transmission structure 84 presses against the second piston 58. The fluid 48 being pushed by the rear piston surface 80 in the chamber 44 gets compressed by the fixed compression wall 60. As the fluid 48 gets compressed in the first chamber 44 for fluid of greater amount 48, the fluid 48 gets pushed into the entry opening 86 of the delivery channel 46, through the delivery channel 46 and into the second chamber 42 for the fluid of greater amount 48 through the exit 88 of the delivery channel 46. At the same time, the pressing of the second transmission structure 84 against the second piston 58 causes the fluid 48 in the second chamber 42 to be pressed into the discharge opening 72, through which the fluid 48 is discharged from the dual fluid cartridge 20. Also, at the same time, the pressing of the first transmission structure 82 against the first piston 56 pushes the fluid of lesser amount 50 in the chamber 40 through the discharge opening 74, where the fluid 50 is discharged from the dual fluid cartridge 20. As the fluids 48, 50 are discharged from the dual fluid cartridge through the discharge openings 72, 74, they are mixed together by the static mixer 31 in the nozzle 34.

Figure 4:
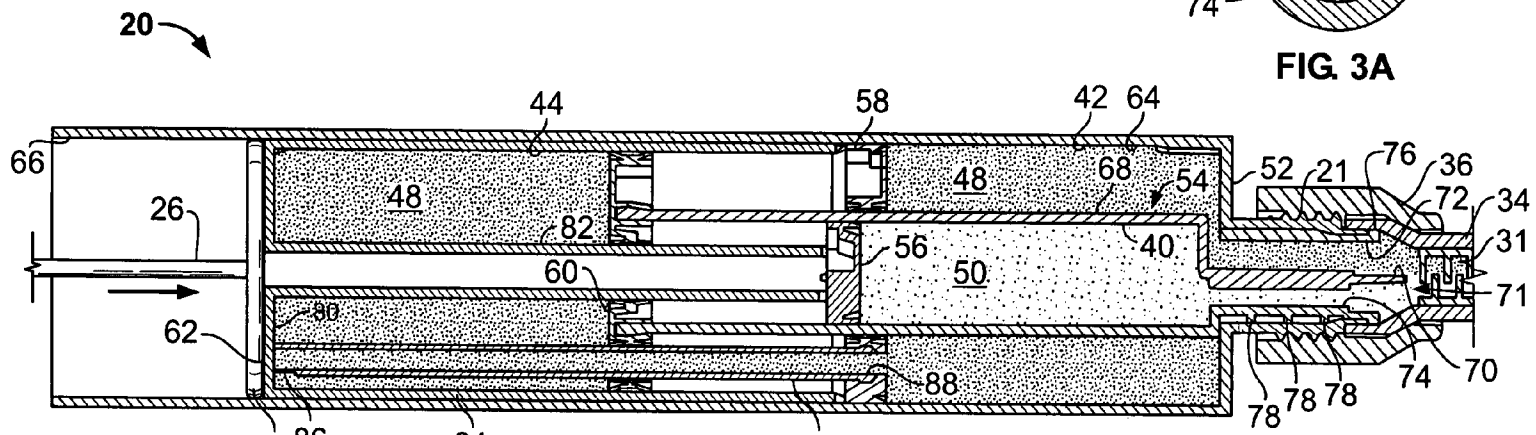
FIG. 4 is a longitudinal sectional view of the dual fluid cartridge depicted in FIG. 3 in an intermediate dispensing position.
Figure 5:
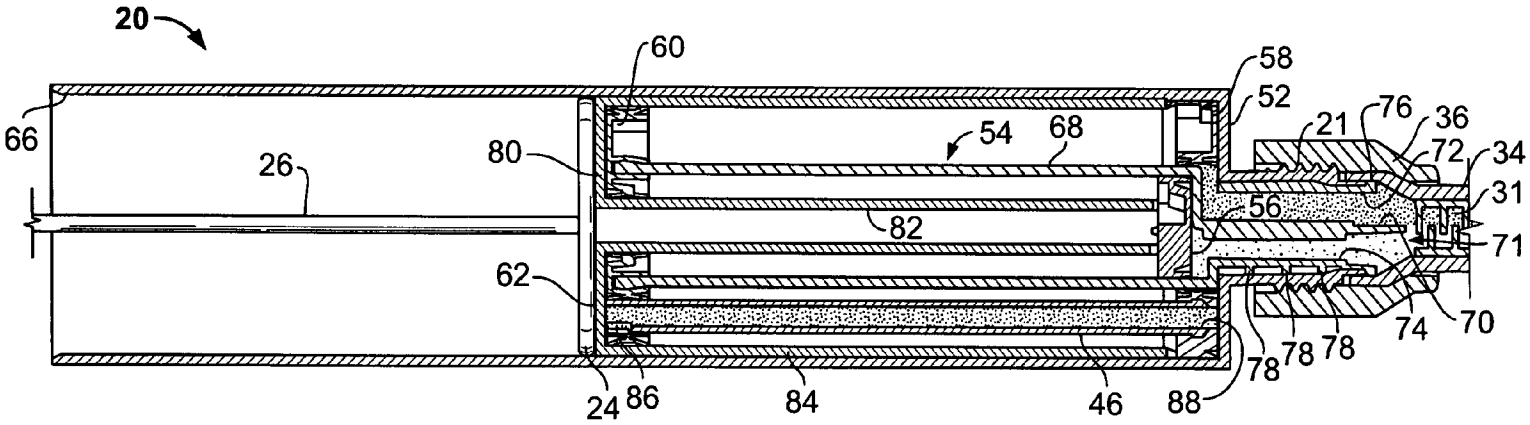
FIG. 5 is a longitudinal sectional view of the dual fluid cartridge depicted in FIG. 3 with the contents of the dual fluid cartridge dispensed.

This fluid discharge and mixing process continues as long as the caulking gun plunger 24 is being actuated and as long as fluids are still left to be dispensed from the dual fluid cartridge 20. FIG. 4 depicts the dual fluid cartridge 20 with a portion of the fluids dispensed from the dual fluid cartridge 20. FIG. 5 depicts the dual fluid cartridge 20 with the fluid contents of the chambers 40, 42, 44 of the cartridge 20 fully dispensed.

The arrangement of the dual fluid cartridge 20 in FIG. 5 is also how the dual fluid cartridge 20 looks prior to being filled. To fill the dual fluid cartridge 20, the chambers 40, 42, 44 are filled with the appropriate fluids 48, 50 through their respective discharge openings 72, 74. The filling process occurs in the reverse manner of the dispensing process described above.

Figure 6:
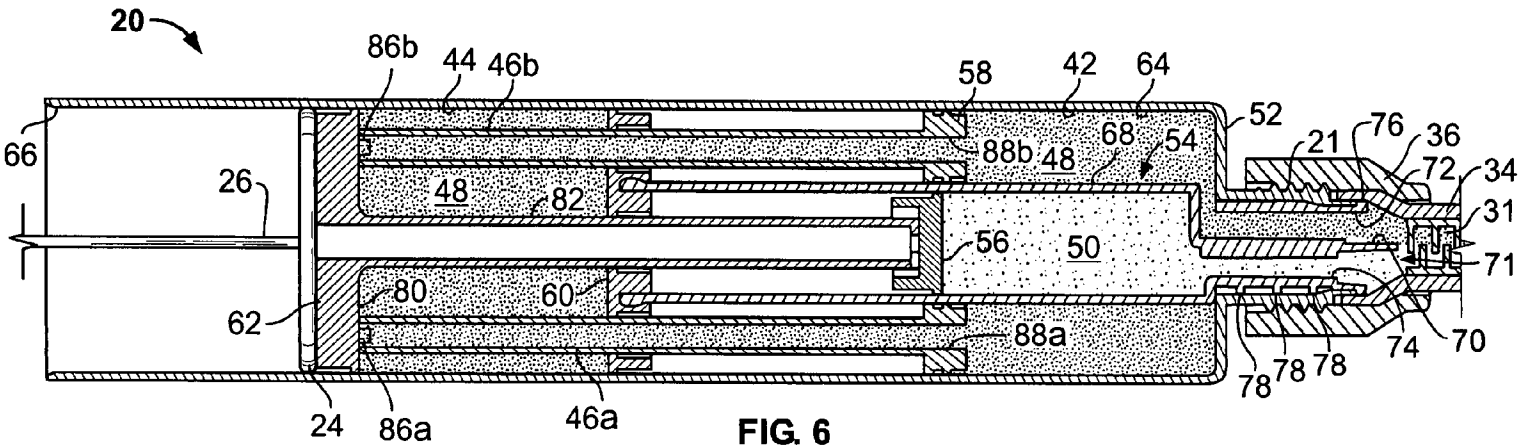
FIG. 6 is longitudinal sectional view of another embodiment of a dual fluid cartridge of the present invention.

It should be understood that many differing embodiments of the dual fluid cartridge 20 of the present invention may be designed and employed. Referring to FIGS. 6-10, several other embodiments of the dual fluid cartridge 20 of the present invention are depicted. In these embodiments, like elements are numbered the same. Referring to FIG. 6, in this embodiment of the dual fluid cartridge 20 of the present invention, two delivery channels 46*a*, 46*b*, instead of one, provide fluid communication between the chambers 42, 44. In this embodiment, the delivery channels 46*a*, 46*b* also serve as the second transmission structure to transmit force to the second piston 58. As such, there is no need for a separate second transmission structure, such as the second transmission structure 84 depicted in FIG. 2. Though this embodiment is shown with two delivery channels 46*a*, 46*b*, it should be understood that more than two delivery channels 46 (e.g. 3 or more) may also be used in the same manner.

Figure 7:
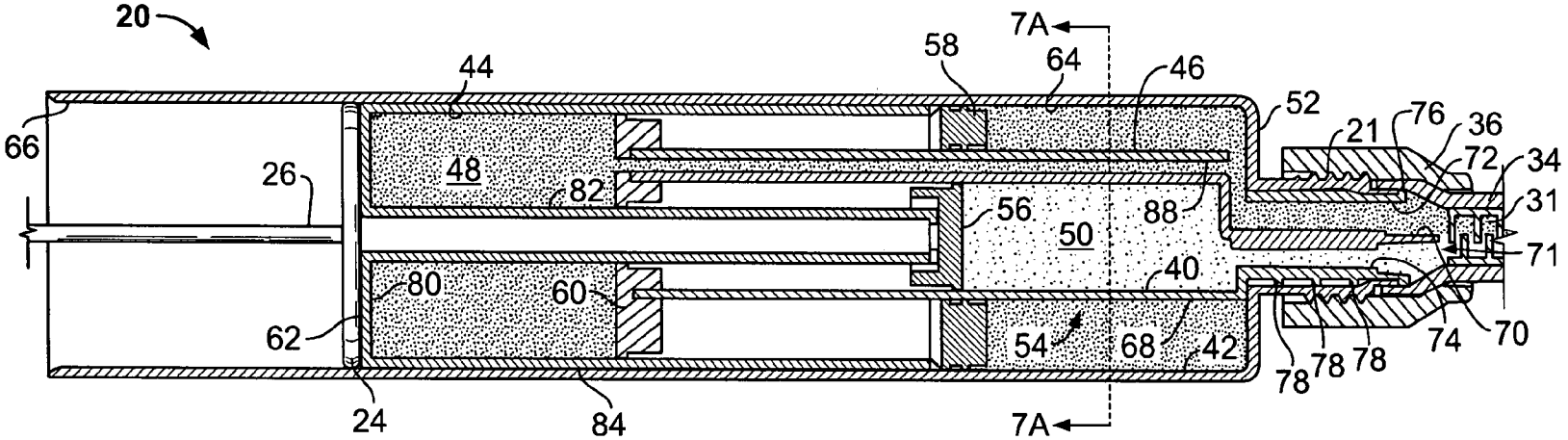
FIG. 7 is longitudinal sectional view of another embodiment of a dual fluid cartridge of the present invention.
Figure 7A:
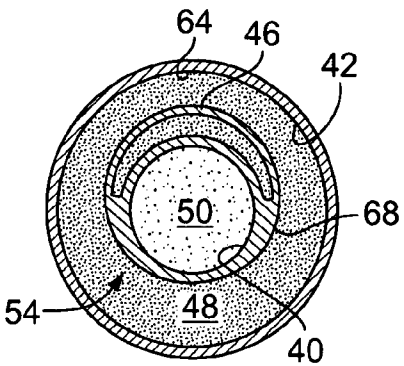
FIG. 7A is cross-sectional view taken along line 7A-7A of FIG. 7.

Referring to FIGS. 7 and 7A, in this embodiment of the dual fluid cartridge 20, the delivery channel 46 is formed integral with the inner cartridge wall 68 of the inner chamber structure 54. The delivery channel 46 can be formed in any shape. In this embodiment, the integrally formed delivery channel 46 is crescent-shaped in order to follow the contour of the inner cartridge wall 68.

Figure 8:
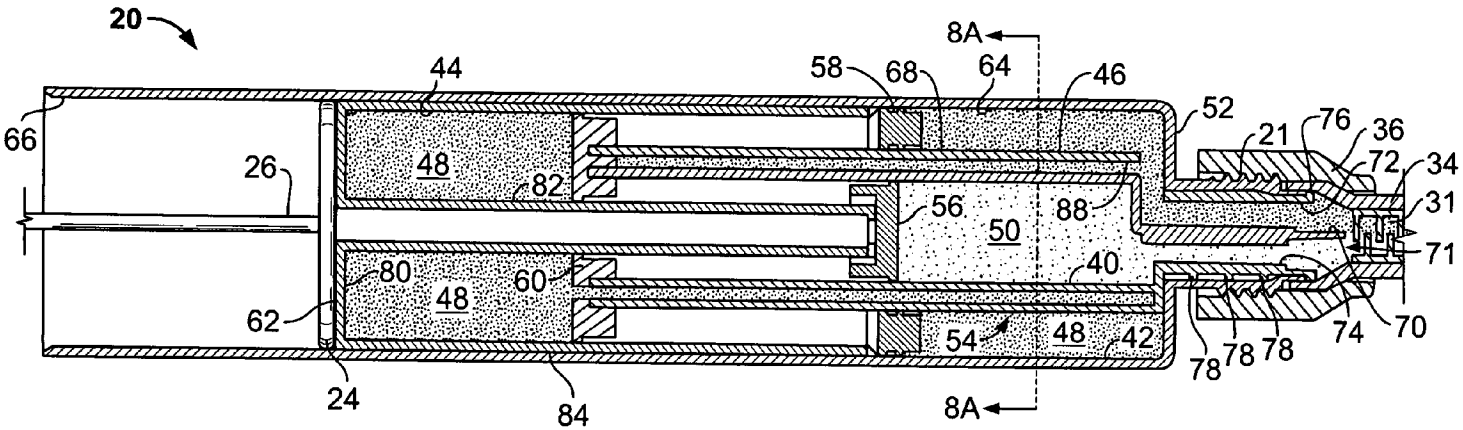
FIG. 8 is longitudinal sectional view of another embodiment of a dual fluid cartridge of the present invention.
Figure 8A:
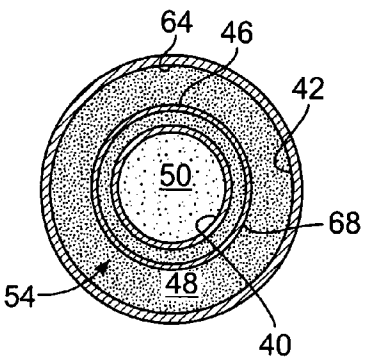
FIG. 8A is cross-sectional view taken along line 8A-8A of FIG. 8.

Referring to FIGS. 8 and 8A, in an embodiment similar to FIGS. 7 and 7A, the delivery channel 46 is formed integral with the inner chamber structure 54, except in this embodiment the delivery channel 46 is an annular passage which surrounds, and is integral with, the inner cartridge wall 68.

Figure 9:
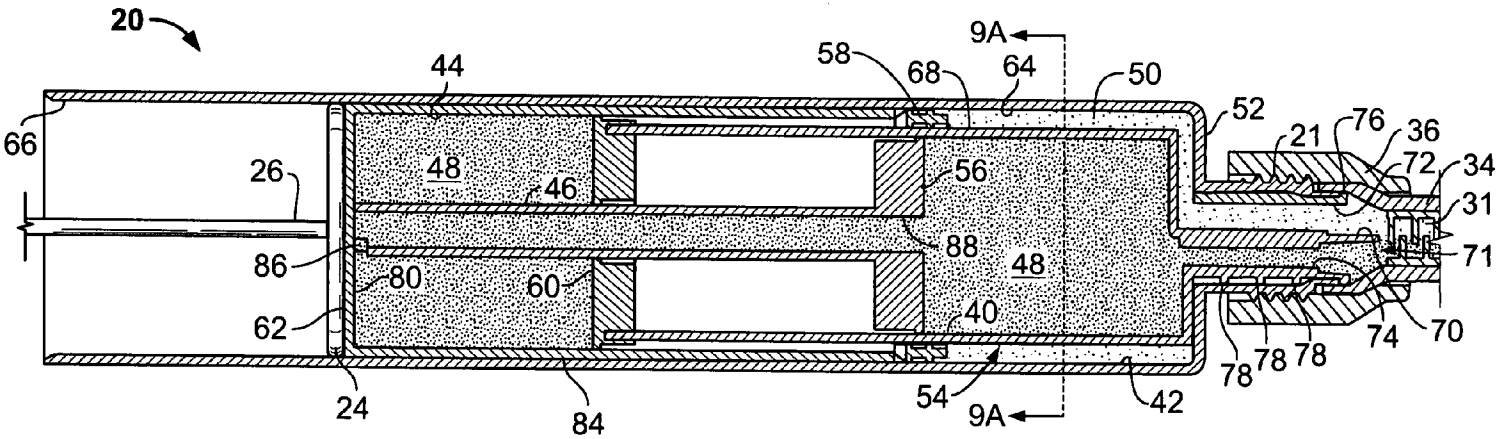
FIG. 9 is longitudinal sectional view of another embodiment of a dual fluid cartridge of the present invention.
Figure 9A:
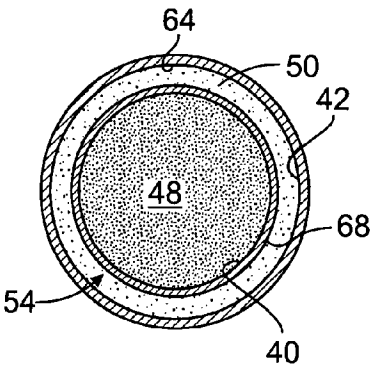
FIG. 9A is cross-sectional view taken along line 9A-9A of FIG. 9.
Figure 10:
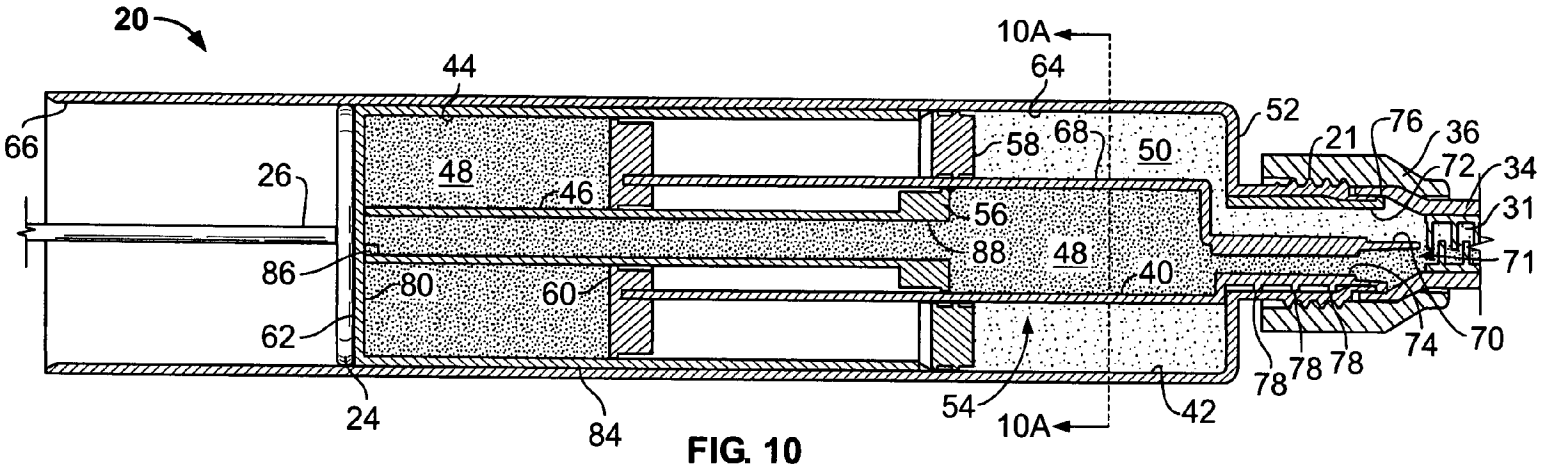
FIG. 10 is longitudinal sectional view of another embodiment of a dual fluid cartridge of the present invention.
Figure 10A:
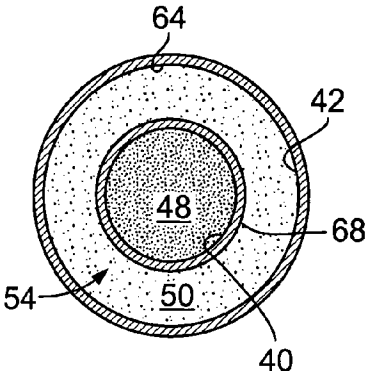
FIG. 10A is cross-sectional view taken along line 10A-10A of FIG. 10.

Referring to FIGS. 9 and 9A, in this embodiment of the dual fluid cartridge 20, the delivery channel 46 serves as the first transmission structure to transmit force to the first piston 56. As such, there is no need for a separate first transmission structure, such as the first transmission structure 82 depicted in FIG. 2. In this embodiment, due to the location of the delivery channel 46, the chamber 40 defined by the first piston 56 and the inner chamber structure 54 now holds a portion of the fluid of greater amount 48, rather than the fluid of lesser amount 50, as in the other embodiments described above. Also, as a result, the chamber 42 defined by the second piston 58, the interior of the outer cartridge wall 52 and the exterior of the inner cartridge wall 68 now holds the fluid of lesser amount 50, instead of a portion of the fluid of greater amount 48. Referring to FIGS. 10 and 10A, an embodiment similar to the embodiment depicted in FIGS. 9 and 9A is shown, except that the chamber 40 is reduced in size and the chamber 42 has increased in size. This occurs in a situation where the ratio between the fluid of greater amount and the fluid of lesser amount required is closer to a 1:1 ratio, such as in a 2:1 ratio situation.

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

What is claimed is:

1. A fluid cartridge for storing and dispensing two fluids, wherein one of the fluids to be stored and dispensed is of a greater amount than the second fluid, comprising:

an outer cartridge wall defining an outlet and an open end opposite the outlet;

an inner cartridge wall disposed within the outer cartridge wall and defining an outlet that is co-located with the outlet defined by the outer cartridge wall;

a first piston disposed within the inner cartridge wall, wherein the inner cartridge wall and the first piston define a fluid chamber for the fluid of lesser amount;

a second piston disposed within the outer cartridge wall between the first piston and the open end of the outer cartridge wall;

a third piston having a seal on its outer periphery disposed between the outer cartridge wall and the inner cartridge wall forming a first fluid chamber for the fluid of greater amount;

a fixed wall disposed between the second piston and the third piston, wherein the fixed wall and the second piston define a second fluid chamber for the fluid of greater amount;

means for transmitting force from the second piston to the first piston;

means for transmitting force from the second piston to the third piston; and a delivery channel disposed between the first and second fluid chambers for the fluid of greater amount, which allows fluid communication between the first and second fluid chambers for the fluid of greater amount.

2. The fluid cartridge of claim 1, wherein the ratio between the fluid of greater amount and the fluid of lesser amount is 10:1.

3. The fluid cartridge of claim 1, wherein the ratio between the fluid of greater amount and the fluid of lesser amount is 2:1.

4. The fluid cartridge of claim 1, wherein the fluid cartridge comprises a plurality of delivery channels disposed between the first and second fluid chambers for the fluid of greater amount.

5. The fluid cartridge of claim 1, wherein the delivery channel is the force transmitting means from the second piston to the third piston.

6. The fluid cartridge of claim 1, wherein the delivery channel is the force transmitting means from the second piston to the first piston.

7. The fluid cartridge of claim 1, wherein the delivery channel is formed integral with the inner cartridge wall.

8. The fluid cartridge of claim 7, wherein the delivery channel is crescent-shaped.

9. The fluid cartridge of claim 7, wherein the delivery channel is an annular passage.

10. The fluid cartridge of claim 1, wherein the outlet defined by the outer cartridge wail has an interior and the outlet defined by the inner cartridge wall is disposed within and spans the interior of the outer cartridge wall outlet.

11. The fluid cartridge of claim 10, wherein the inner cartridge wall outlet defines a first opening for discharge of the fluid of greater amount and a second opening for discharge of the fluid of lesser amount.

12. The fluid cartridge of claim 10, wherein the inner cartridge wall, outlet has an exterior surface with ribs formed along the exterior surface, wherein the ribs secure the inner cartridge wall outlet within the interior of the outer cartridge wall outlet.

13. A fluid cartridge for storing and dispensing two fluids, wherein one of the fluids to be stored and dispensed is of a greater amount than the second fluid, comprising:

an outer cartridge wall defining an outlet and an open end opposite the outlet;

an inner cartridge wall disposed within the outer cartridge wall and defining an outlet that is co-located with the outlet defined by the outer cartridge wall;

a first piston disposed within the inner cartridge wall, wherein the inner cartridge wall and the first piston define a fluid chamber for the fluid of lesser amount;

a second piston disposed within the outer cartridge wall between the first piston and the open end of the outer cartridge wall;

a third piston having a seal on its outer periphery disposed between the outer cartridge wall and the inner cartridge wall forming a first fluid chamber for the fluid of greater amount;

a fixed wall disposed between the second piston and the third piston, wherein the fixed wall and the second piston define a second fluid chamber for the fluid of greater amount;

a first transmission structure disposed between the second piston and the first piston;

a second transmission structure disposed between the second piston and the third piston; and a delivery channel disposed between the first and second fluid chambers for the fluid of greater amount, which allows fluid communication between the first and second fluid chambers for the fluid of greater amount.

14. The fluid cartridge of claim 13, wherein the ratio between the fluid of greater amount and the fluid of lesser amount is 10:1.

15. The fluid cartridge of claim 13, wherein the ratio between the fluid of greater amount and the fluid of lesser amount is 2:1.

16. The fluid cartridge of claim 13, wherein the fluid cartridge comprises a plurality of delivery channels disposed between the first and second fluid chambers for the fluid of greater amount.

17. The fluid cartridge of claim 13, wherein the delivery channel is formed integral with the second transmission structure.

18. The fluid cartridge of claim 13, wherein the delivery channel is formed integral with the first transmission structure.

19. The fluid cartridge of claim 13, wherein the delivery channel is formed integrally with the inner cartridge wall.

20. The fluid cartridge of claim 19, wherein the delivery channel is crescent-shaped.

21. The fluid cartridge of claim 19, wherein the delivery channel is an annular passage.

22. The fluid cartridge of claim 13, wherein the outlet defined by the outer cartridge wall has an interior and the outlet defined by the inner cartridge wall is disposed within and spans the interior of the outer cartridge wall outlet.

23. The fluid cartridge of claim 22, wherein the inner cartridge wall outlet defines a first opening for discharge of the fluid of greater amount and a second opening for discharge of the fluid of lesser amount.

24. The fluid cartridge of claim 22, wherein the inner cartridge wall outlet has an exterior surface with ribs formed along the exterior surface, wherein the ribs secure the inner cartridge wall outlet within the interior of the outer cartridge wall outlet.

25. A fluid cartridge for storing and dispensing two fluids, wherein one of the fluids to be stored and dispensed is of a greater amount than the second fluid, comprising:

an outer cartridge wall defining an outlet and an open end opposite the outlet;

an inner cartridge wall disposed within the outer cartridge wall and defining an outlet that is co-located with the outlet defined by the outer cartridge wall;

a first piston disposed between the outer cartridge wall and the inner cartridge wall forming a fluid chamber for the fluid of lesser amount;

a second piston disposed within the outer cartridge wall between the first piston and the open end of the outer cartridge wall;

a third piston having a seal on its outer periphery disposed within the inner cartridge wall, wherein the inner cartridge wall and the third piston define a first fluid chamber for the fluid of greater amount a fixed wall disposed between the second piston and the third piston, wherein the fixed wall and the second piston define a second fluid chamber for the fluid of greater amount;

means for transmitting force from the second piston to the first piston;

means for transmitting force from the second piston to the third piston; and a delivery channel disposed between the first and second fluid chambers for the fluid of greater amount, which allows fluid communication between the first and second fluid chambers for the fluid of greater amount.

26. The fluid cartridge of claim 25, wherein the ratio between the fluid of greater amount and the fluid of lesser amount is 10:1.

27. The fluid cartridge of claim 25, wherein the ratio between the fluid of greater amount and the fluid of lesser amount is 2:1.

* * * * *

UNITED STATES PATENT AND TRADEMARK OFFICE

CERTIFICATE OF CORRECTION

PATENT NO. : 7,237,693 B2
APPLICATION NO. : 10/938328
DATED : July 3, 2007
INVENTOR(S) : Robert C. Brennan et al.

It is certified that error appears in the above-identified patent and that said Letters Patent is hereby corrected as shown below:

Title Page
In the inventor listing item "(75) Inventors" on sheet 1, the name of inventor ROBERT W. SPRINGHORN is misspelled. Instead of "Robert W. Springhom", it should correctly read --Robert W. Springhorn--.

In the assignee listing item "(73) Assignee" on sheet 1, the "TAH" portion of the assignee's name should be identified as all uppercase letters to read --TAH Industries, Inc.--

Signed and Sealed this

Twenty-seventh Day of November, 2007

JON W. DUDAS
*Director of the United States Patent and Trademark Office*